US010315668B2

(12) United States Patent
Early

(10) Patent No.: US 10,315,668 B2
(45) Date of Patent: Jun. 11, 2019

(54) HOPPER CAR GATE WITH MULTIPLE OPENINGS

(71) Applicant: AERO TRANSPORTATION PRODUCTS, INC., Independence, MO (US)

(72) Inventor: Stephen R Early, Olathe, KS (US)

(73) Assignee: AERO TRANSPORTATION PRODUCTS, INC., Independence, MO (US)

( * ) Notice: Subject to any disclaimer, the term of this patent is extended or adjusted under 35 U.S.C. 154(b) by 195 days.

(21) Appl. No.: 15/401,580

(22) Filed: Jan. 9, 2017

(65) Prior Publication Data

US 2018/0194372 A1 Jul. 12, 2018

(51) Int. Cl.

| | |
|---|---|
| ***B61D 7/02*** | (2006.01) |
| ***B61D 7/20*** | (2006.01) |
| ***B61D 7/26*** | (2006.01) |

(52) U.S. Cl.

CPC ..... *B61D 7/02* (2013.01); *B61D 7/20* (2013.01); *B61D 7/26* (2013.01)

(58) Field of Classification Search

CPC ... B61D 7/20; B61D 7/02; B61D 7/26; B61D 7/24; B61D 17/08; B65D 90/587; B65D 90/60; B60P 1/56

USPC ..... 105/282.3, 253

See application file for complete search history.

(56) References Cited

U.S. PATENT DOCUMENTS

| | | | | |
|---|---|---|---|---|
| 820,240 | A | 5/1906 | Mulock | |
| 4,628,825 | A | 12/1986 | Taylor et al. | |
| 5,584,251 | A | 12/1996 | Lucas | |
| 6,012,397 | A | 1/2000 | Krahl et al. | |
| 6,073,562 | A | 6/2000 | Cozine et al. | |
| 6,263,803 | B1 | 7/2001 | Dohr et al. | |
| 6,286,437 | B1 | 9/2001 | Lucas | |
| 6,571,718 | B2 | 6/2003 | Lucas | |
| 6,899,038 | B2 | 5/2005 | Fortuna | |
| 7,124,693 | B2 | 10/2006 | Lucas | |
| 7,171,907 | B2 * | 2/2007 | Early | B61D 7/20 105/247 |
| 7,367,271 | B2 | 5/2008 | Early | |
| 7,559,283 | B2 | 7/2009 | Clark | |
| 7,752,979 | B2 | 7/2010 | Early | |
| 7,806,057 | B2 | 10/2010 | Early | |

(Continued)

FOREIGN PATENT DOCUMENTS

| | | | |
|---|---|---|---|
| CN | 105083303 A | | 11/2015 |
| FR | 339390 | * | 4/1904 |

*Primary Examiner* — Mark T Le

(74) *Attorney, Agent, or Firm* — Stinson Leonard Street LLP

(57) ABSTRACT

A hopper car gate with a frame having multiple openings and one or more solid sections positioned between adjacent openings, an operating mechanism coupled to the frame, and a door supported by the frame. The door has multiple solid sections to match the number of openings in the frame and one or more openings positioned between adjacent solid sections. The door is movable by the operating mechanism between a closed position, in which the solid sections of the door block the openings in the frame, and an open position, in which the openings in the door are aligned with at least some of the openings in the frame and the solid sections of the door are aligned with at least some of the solid sections of the frame.

14 Claims, 9 Drawing Sheets

(56) References Cited

U.S. PATENT DOCUMENTS

| | | | | |
|---|---|---|---|---|
| 7,814,842 | B2 | 10/2010 | Early | |
| 7,819,067 | B2 | 10/2010 | Early | |
| 8,371,235 | B1 | 2/2013 | Early | |
| 8,534,204 | B2 | 9/2013 | Blankenship | |
| 8,850,991 | B2 | 10/2014 | Early | |
| 9,358,988 | B2 | 6/2016 | Early | |
| 2010/0107924 | A1* | 5/2010 | Early | B61D 7/20 105/282.3 |

* cited by examiner

HOPPER CAR GATE WITH MULTIPLE OPENINGS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention is related generally to hopper cars and in particular to a hopper car gate having multiple openings.

2. Description of Related Art

Hopper cars are commonly used to transport bulk materials. Hopper cars include one or more hoppers which hold bulk materials or other cargo for shipment. Each hopper has a discharge opening at its bottom in order to discharge the cargo upon arrival at its intended destination. A gate is joined to each opening to control the discharge of cargo from the hopper. Typically, the gate will have a frame defining an opening and a door moveable between a closed position which blocks the opening and an open position which allows cargo to exit through the opening. An opening mechanism allows a user to move the door between its closed and open positions.

The hopper openings must be spaced a distance sufficient to prevent interference between adjacent hopper gate doors when they are in their open position. Between adjacent hopper openings there are sloped hopper surfaces to facilitate discharge of the cargo within the hoppers. The area beneath the sloped surfaces is wasted space. Reducing the spacing between adjacent hopper openings reduces the wasted space beneath the sloped hopper surfaces, thus increasing the hopper car's carrying capacity. The length or width of hopper cars cannot be increased to increase carrying capacity because there are maximum exterior dimensions to which hopper cars must conform. For example, the Association of American Railroads (AAR) establishes maximum clearance dimensions for all railcars including hopper cars. It is important to maximize a hopper car's carrying capacity while ensuring the car has dimensions within the specified maximum clearance dimensions.

BRIEF SUMMARY OF THE INVENTION

A hopper car gate with a frame having at least first and second openings and a solid section positioned between the first and second openings, an operating mechanism coupled to the frame, and a door supported by the frame. The door has at least first and second solid sections with an opening positioned between the first and second solid sections. The door is movable by the operating mechanism between a closed position, in which the first and second solid sections of the door block the first and second openings in the frame, respectively, and an open position, in which the opening in the door is aligned with at least one of the first and second openings in the frame and the solid section of the frame is aligned with at least one of the first and second solid sections of the door.

Preferably, the operating mechanism includes a shaft coupled to the frame and a gear mounted to the shaft. The gear preferably engages a gear rack on the door. The door preferably includes a central portion, a first side portion coupled to and extending outward from a first side of the central portion, and a second side portion coupled to and extending outward from a second side of the central portion. Preferably, each of the first and second side portions is continuous and solid.

Because the hopper car gate has a frame with multiple, spaced apart openings, the door only needs to move a relatively short distance from its closed position to its open position, in which cargo may discharge through each opening in the frame. The multiple openings in the frame give the gate a relatively large overall discharge opening size in comparison to the overall size of the frame. Since the door only moves a short distance, it does not extend an appreciable distance outward from the frame when the door is in its open position. This allows two of the gates to be positioned relatively close together without interference between the doors of the gates when the doors are opened. By spacing the gates close together, the overall cargo carrying capacity of the car to which the gates are mounted may be increased due to a reduction in the wasted space underneath the sloped surfaces of adjacent hoppers.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
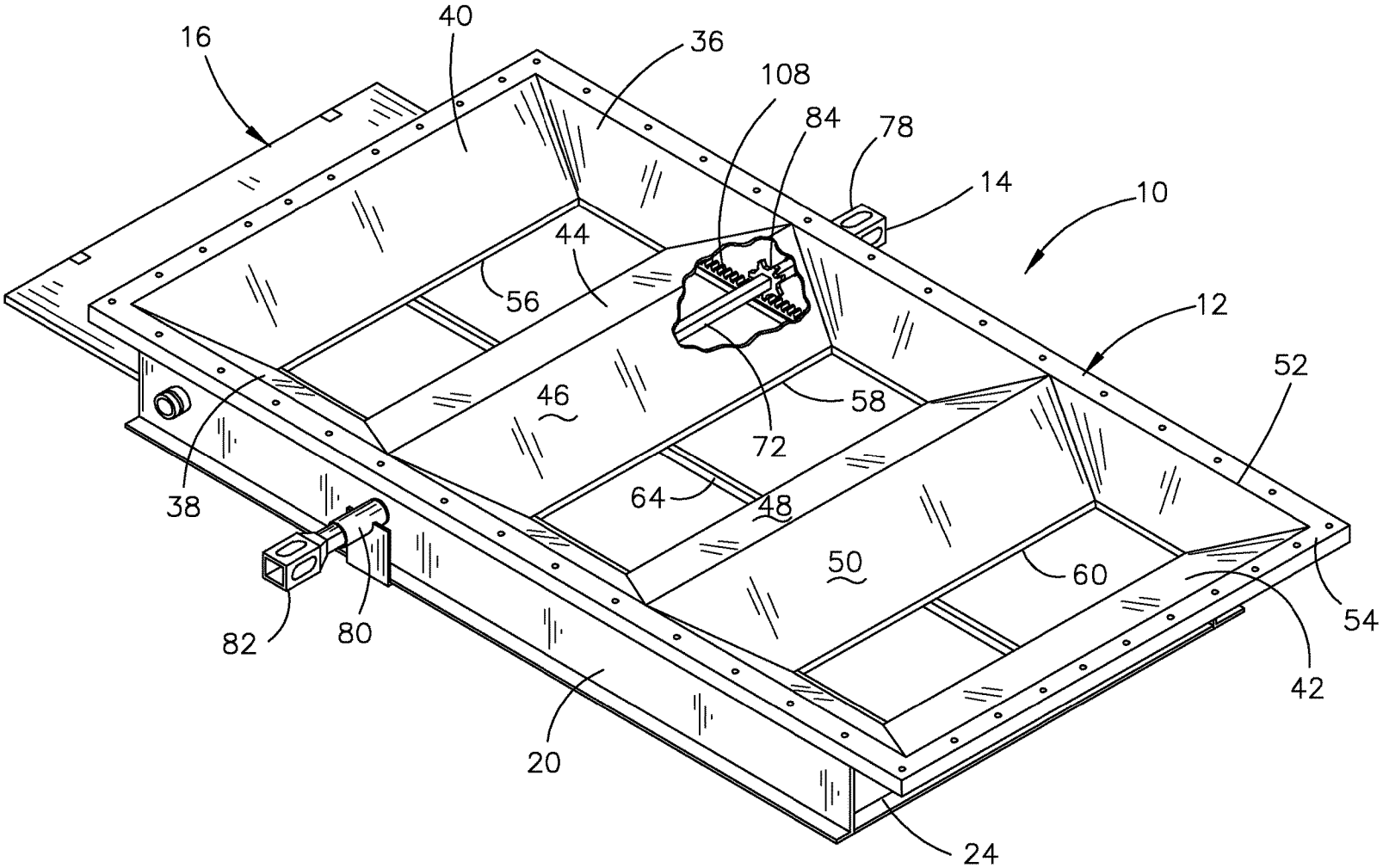
FIG. 1 is a perspective view of a hopper car gate with a door in an open position.

A hopper car gate in accordance with one embodiment of the invention described herein is identified generally in FIG. 1 as 10. Hopper car gate 10 has a frame 12, an operating mechanism 14 that is coupled to the frame 12, and a door 16 that is supported by the frame 12. Hopper car gate 10 has a relatively large total opening area for cargo to pass through when the door 16 is in the open position shown in FIG. 1. Further, the door 16 only moves a relatively short distance from the closed position shown in FIG. 2 to the open position shown in FIG. 1, which means that the door 16 extends only a relatively short distance beyond the frame 12, if at all, when the door 16 is in the open position.

Figure 6:
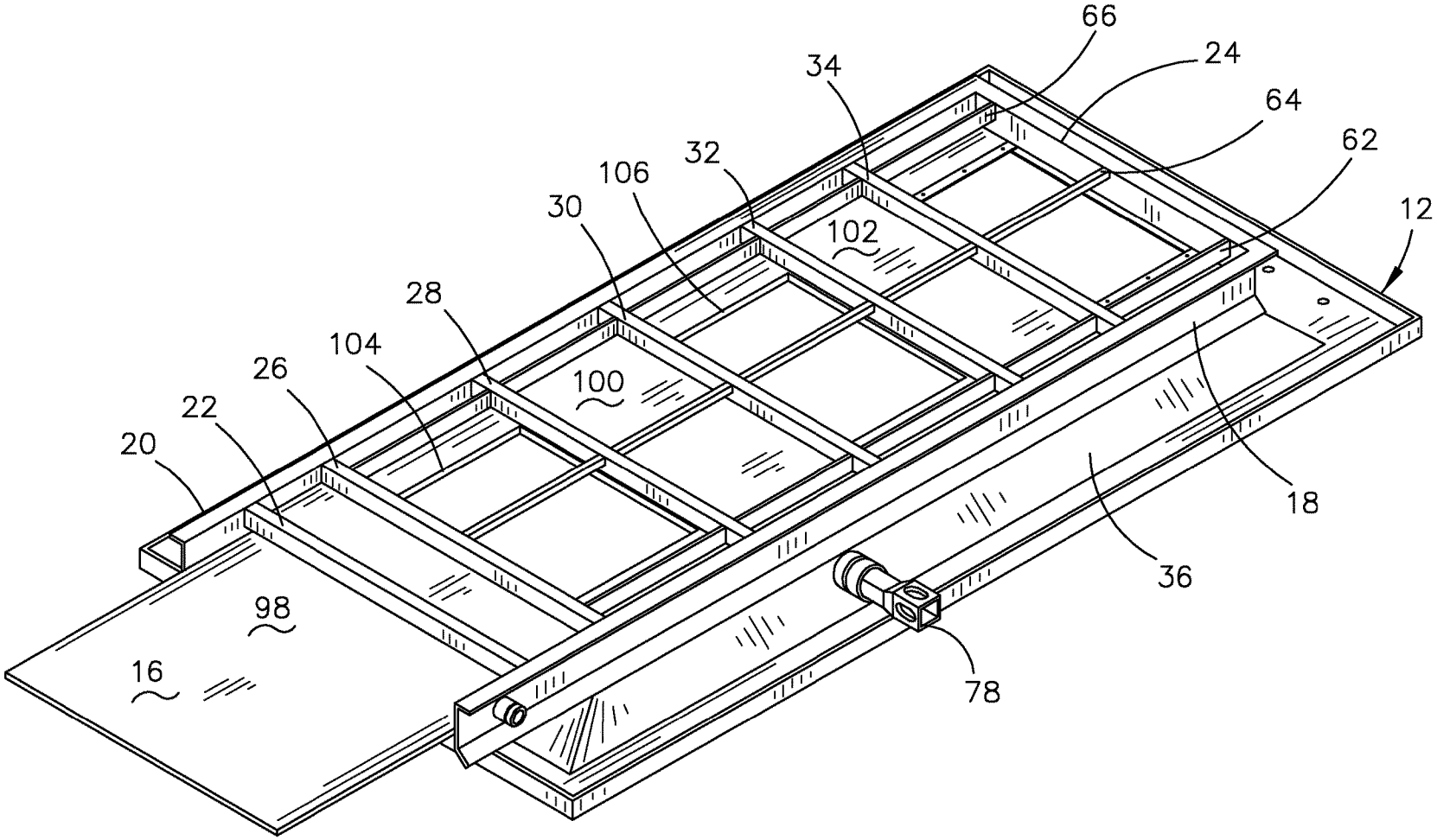
FIG. 6 is a perspective view showing a bottom of the hopper car gate of FIG. 1 with the door in the open position.
Figure 7:
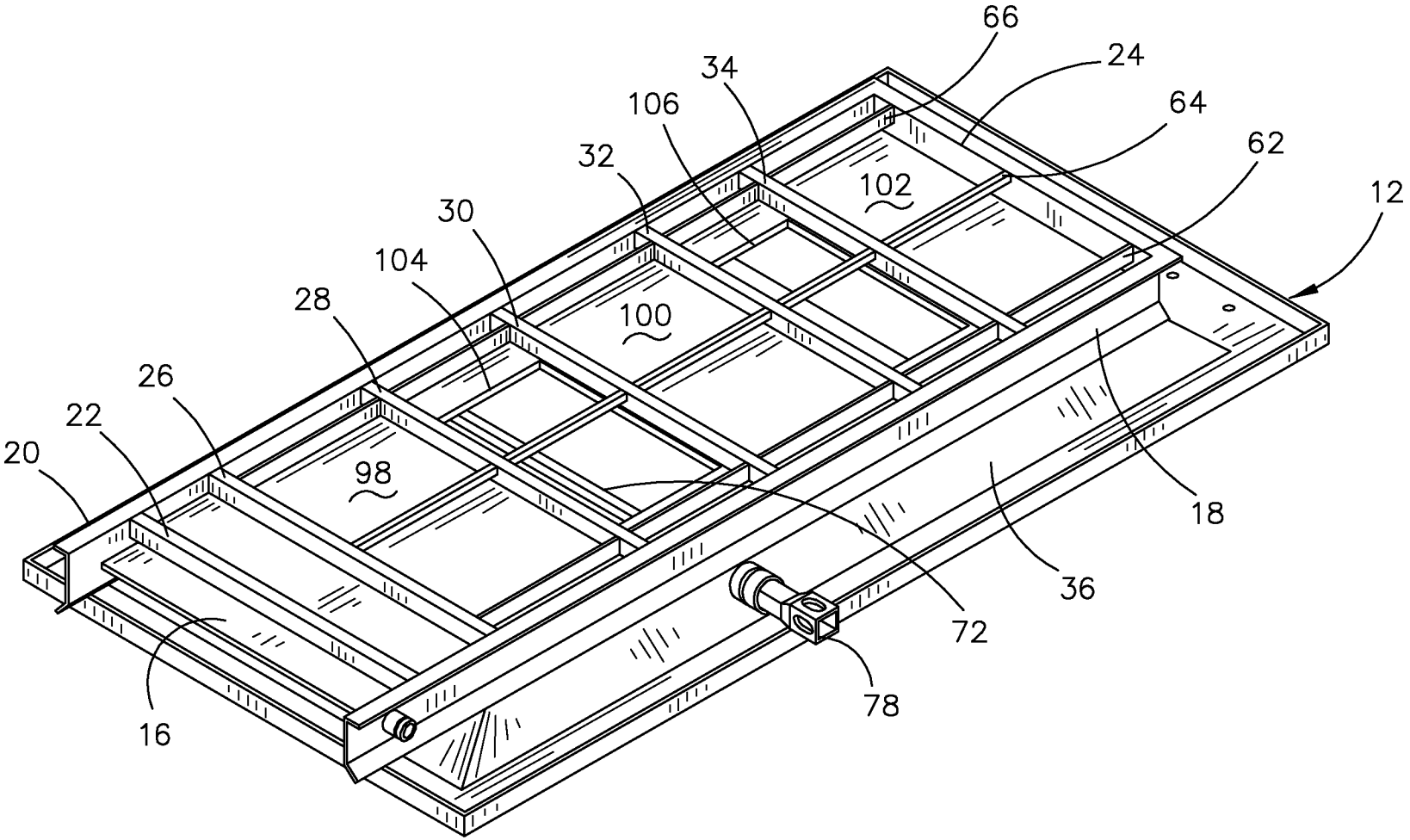
FIG. 7 is a perspective view similar to FIG. 6 but with the door in the closed position.

Referring to FIG. 6, frame 12 has first and second side rails 18 and 20 joined by a first vertical section 22, a second vertical section 24, and cross rails 26, 28, 30, 32, and 34. First and second side walls 36 and 38 (shown in FIG. 1) are joined to first and second side rails 18 and 20, respectively, and first and second end walls 40 and 42 are joined to first and second vertical sections 22 and 24, respectively. First and second side walls 36 and 38 are joined with first and second end walls 40 and 42 at the corners of the frame 12. A first solid section includes first and second dividing walls 44 and 46 each of which joined with and extending between first and second side walls 36 and 38. A second solid section includes third and fourth dividing walls 48 and 50 each of which joined with and extending between first and second side walls 36 and 38. A top opening 52 of frame 12 is formed by side and end walls 36, 38, 40, and 42. Top opening 52 is surrounded by a flange 54 that is mounted to and extends away from an upper portion of side and end walls 36, 38, 40, and 42. Flange 54 includes openings that are configured to receive fasteners for joining hopper car gate 10 to the hopper of a railcar. First and second side rails 18 and 20 and first and second vertical sections 22 and 24 include a bottom flange extending around a bottom of the frame 12.

Frame 12 includes first, second, and third bottom openings 56, 58, and 60, respectively. First bottom opening 56 is formed by first end wall 40, first and second side walls 36 and 38, and first dividing wall 44. Second bottom opening 58 is formed by second dividing wall 46, third dividing wall 48, and first and second side walls 36 and 38. Third bottom opening 60 is formed by second end wall 42, first and second side walls 36 and 38, and fourth dividing wall 50. First and second dividing walls 44 and 46 are positioned between first and second bottom openings 56 and 58, and third and fourth dividing walls 48 and 50 are positioned between second and third bottom openings 58 and 60.

Side and end walls 36, 38, 40, and 42 slope downward and inward from top opening 52 to bottom openings 56, 58, and 60 to facilitate discharge of cargo through bottom openings 56, 58, and 60 when door 16 is in the open position shown in FIG. 1. Upper ends of first and second dividing walls 44 and 46 are joined together adjacent top opening 52, and upper ends of third and fourth dividing walls 48 and 50 are joined together adjacent top opening 52. First dividing wall 44 slopes from its upper end to opening 56 downward and toward first end wall 40. Second dividing wall 46 slopes from its upper end to opening 58 downward and toward third dividing wall 48. Third dividing wall 48 slopes from its upper end to opening 58 downward and toward second dividing wall 46. Fourth dividing wall 50 slopes from its upper end to opening 60 downward and toward second end wall 42.

Figure 8:
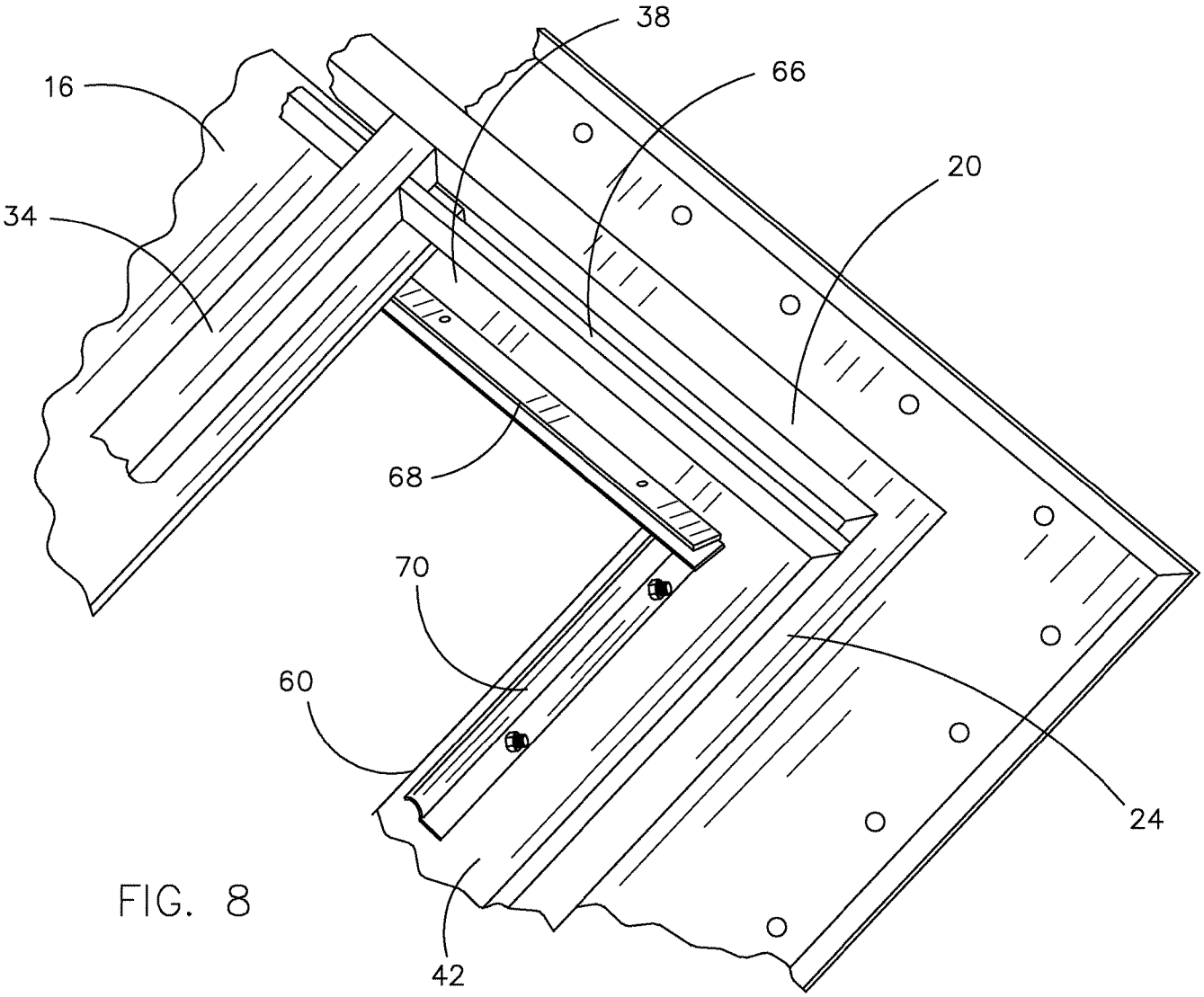
FIG. 8 is a perspective view of a portion of the bottom of the hopper car gate of FIG. 1 showing a pair of seals.

Three door support rails 62, 64, and 66, shown in FIG. 6, extend between the first vertical section 22 and the second vertical section 24 of the frame 12 just below bottom openings 56, 58, and 60. Door 16 is supported by the door support rails 62, 64, and 66 adjacent openings 56, 58, and 60. Referring to FIG. 8, a side seal assembly 68 is mounted to the bottom of side wall 38 to prevent material from passing between door 16 and side wall 38 when the door 16 is in its closed position, and another side seal assembly (not shown) is preferably mounted to the bottom of side wall 36. An end seal assembly 70 is mounted to the bottom of end wall 42 to prevent material from passing between door 16 and end wall 42 when the door 16 is in its closed position, and another end seal assembly (not shown) is preferably mounted to the bottom of end wall 40. Similar seal assemblies (not shown) are also preferably mounted to cross rails 26, 28, 30, 32, and 34 to prevent material from leaking through the bottom openings 56, 58, and 60 when door 16 is closed and to prevent material from entering the space under dividing walls 44 and 46 and interfering with operating mechanism 14.

The components of frame 12 described above, namely, side rails 18 and 20, vertical sections 22 and 24, cross rails 26, 28, 30, 32, and 34, side walls 36 and 38, end walls 40 and 42, dividing walls 44, 46, 48, and 50, flange 52, and door support rails 62, 64, and 66, are preferably joined by welding. While frame 12 is shown and described herein with three bottom openings 56, 58, and 60, it is within the scope of the invention for frame 12 to have only two bottom openings, in which case third and fourth dividing walls 48 and 50 may be omitted. Further, frame 12 may have more than three bottom openings, in which case frame 12 would have additional sets of dividing walls extending between side walls 36 and 38.

Figure 5:
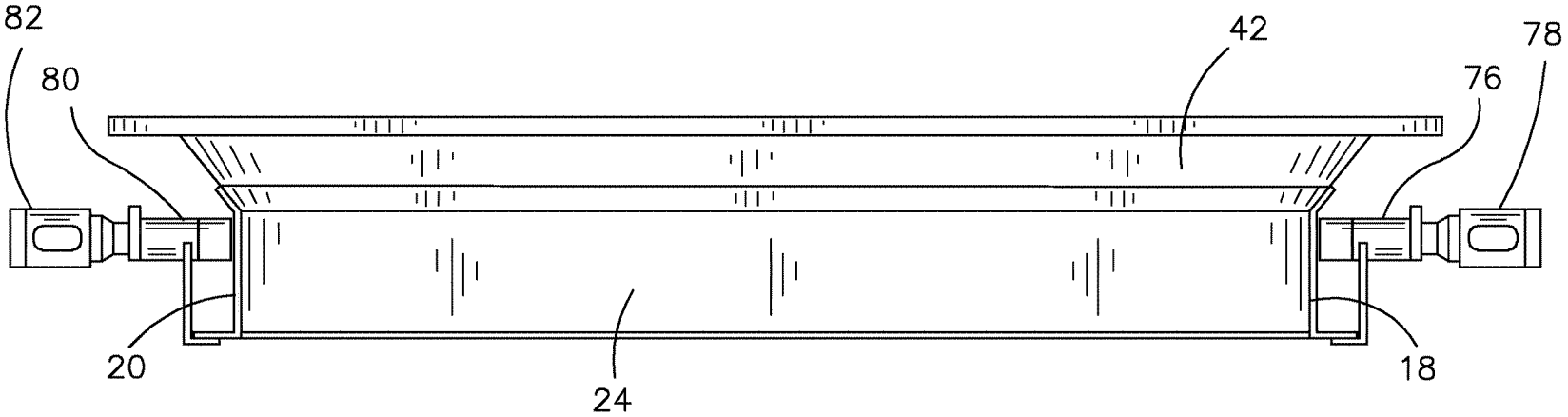
FIG. 5 is a rear elevational view of the hopper car gate of FIG. 1.
Figure 10:
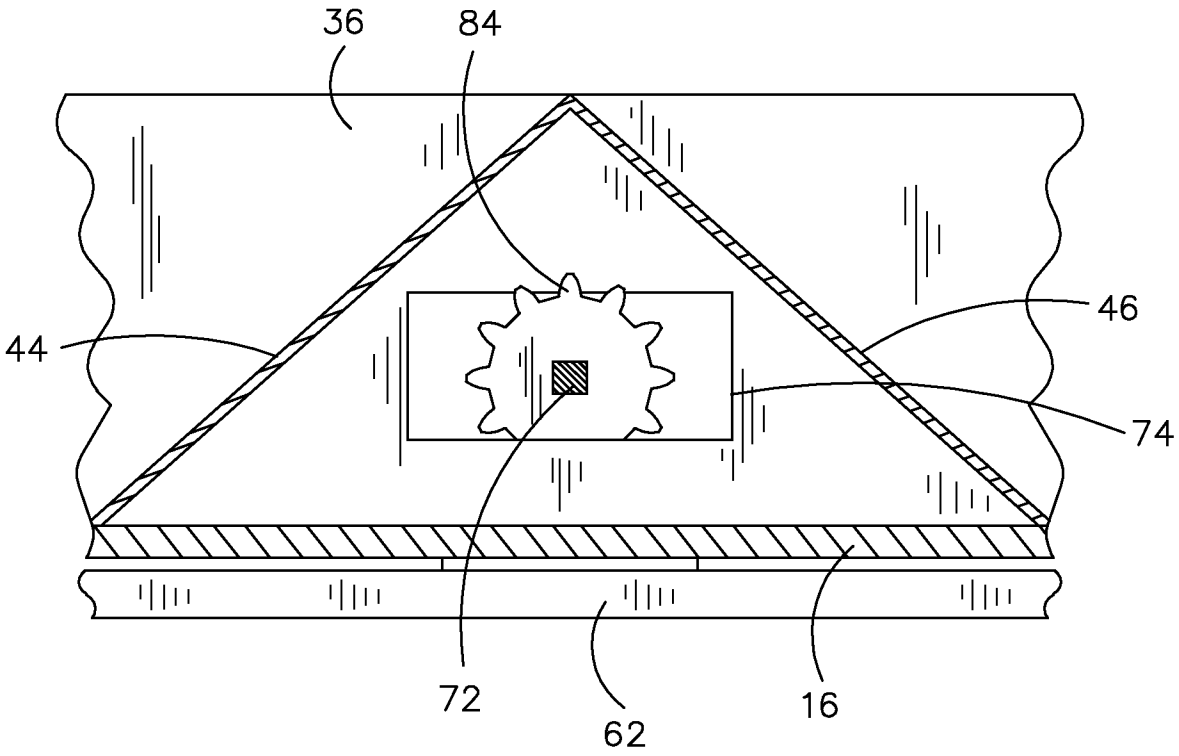
FIG. 10 is a cross-sectional view through the line 10-10 of FIG. 2.

Referring to FIG. 1, operating mechanism 14 includes a shaft 72 that is supported by frame 12 such that shaft 72 is rotatable with respect to frame 12. As shown in FIG. 10, shaft 72 extends through an opening 74 in first side wall 36. Shaft 72 extends through another opening (not shown) in first side rail 18 aligned with opening 74 and into a support tube 76 (FIG. 5) that is joined to and extends outward from first side rail 18. A socket 78 is mounted to the end of shaft 72 and includes an opening for receiving a tool that can rotate shaft 72. Shaft 72 also extends through aligned openings (not shown) in second side wall 38 and second side rail 20 and into a support tube 80 that is joined to and extends outward from second side rail 20. A socket 82 is mounted to the end of shaft 72 and includes an opening for receiving a tool that can rotate shaft 72. Bearings or bushings (not shown) may be mounted within the support tubes 76 and 80 to receive shaft 72 and facilitate its rotation with respect to frame 12. Shaft 72 is positioned under the first and second dividing walls 44 and 46.

Figure 4:
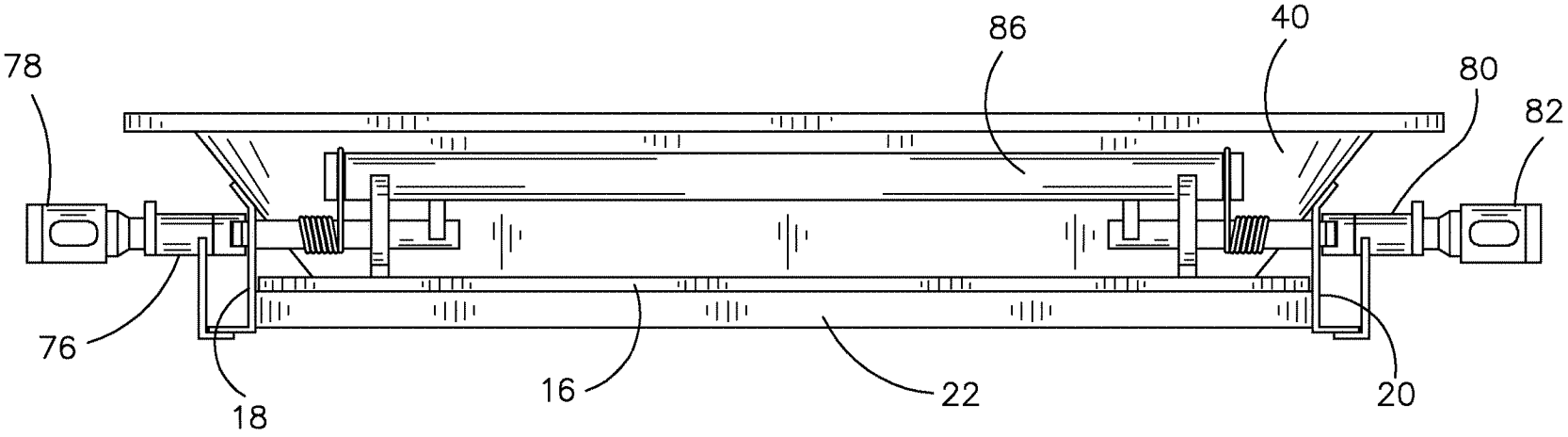
FIG. 4 is a front elevational view of the hopper car gate of FIG. 1.

A first gear 84 is mounted to shaft 72 adjacent first side rail 18. First gear 84 is positioned beneath first and second dividing walls 44 and 46. As shown in FIG. 10, first gear 84 extends through opening 74 in first side wall 36. A second gear (not shown) is mounted to shaft 72 adjacent second side rail 20. The second gear is also positioned beneath first and second dividing walls 44 and 46 and extends through an opening (not shown) in second side wall 38. A locking mechanism 86, shown in FIG. 4, is joined to and extends between side rails 18 and 20 for preventing unwanted motion of door 16, as described in U.S. Pat. No. 7,171,907.

Figure 9:
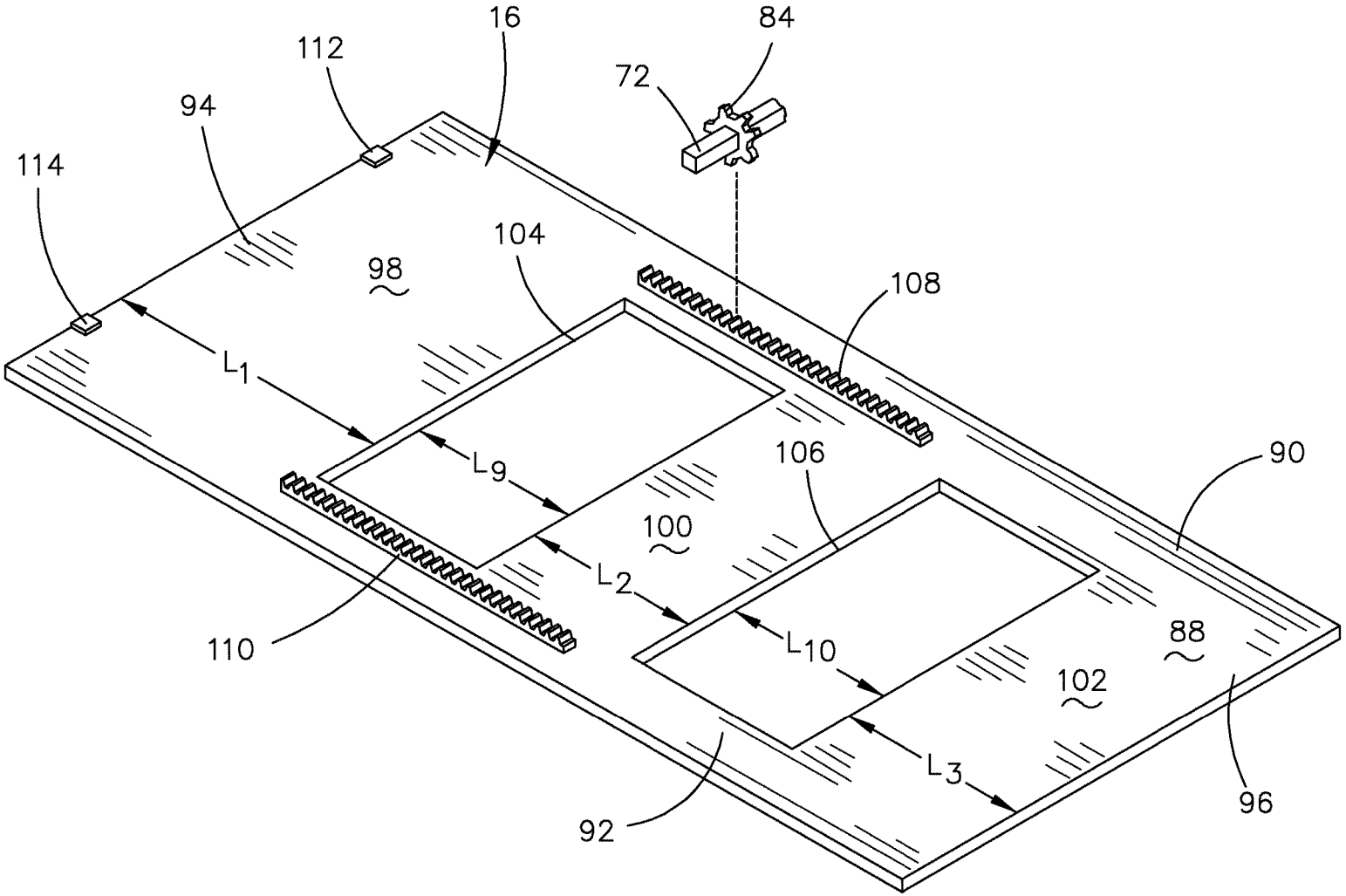
FIG. 9 is a perspective view of the door of the hopper car gate of FIG. 1.

As shown in FIG. 9, door 16 includes a central portion 88, a first side portion 90 joined to and extending outward from a first side of the central portion 88, and a second side portion 92 joined to and extending outward from a second side of the central portion 88. Each of the first and second side portions 90 and 92 is continuous and solid from a first end 94 of the door 16 to a second end 96 of the door 16. Central portion 88 has a first solid section 98, a second solid section 100, a third solid section 102, a first opening 104 positioned between the first and second solid sections 98 and 100, and a second opening 106 positioned between the second and third solid sections 100 and 102. It is within the scope of the invention for door 16 to only include two solid sections with one opening positioned between the solid sections. Further, door 16 may have more than three solid sections with an opening positioned between each solid section. Door 16 preferably has the same number of solid sections as the number of bottom openings 56, 58, and 60 in frame 12.

The openings 104 and 106 in door 16 are sized to be approximately the same size as the openings 56, 58, and 60 in frame 12. The lengths L1, L2, and L3 of solid sections 98, 100, and 102, respectively, are sized to be at least slightly greater than the lengths L4, L5, and L6 (see FIG. 2) of bottom openings 56, 58, and 60 so that the solid sections 98, 100, and 102 completely block openings 56, 58, and 60 when the door 16 is in the closed position to prevent commodity from passing through openings 56, 58, and 60. The length L2 is preferably approximately the same as the length L7 of first and second dividing walls 44 and 46 so that solid section 100 is positioned beneath dividing walls 44 and 46 when door 16 is in the open position. Likewise, the length L3 is preferably approximately the same as the length L8 of third and fourth dividing walls 48 and 50 so that solid section 102 is positioned beneath dividing walls 48 and 50 when door 16 is in the open position. The length L9 of opening 104 in door 16 is less than the length L7 of first and second dividing walls 44 and 46 so that opening 104 is completely covered when the door 16 is in its closed position. Likewise, the length L10 of opening 106 in door 16 is less than the length L8 of third and fourth dividing walls 48 and 50 so that opening 106 is completely covered when door 16 is in its closed position. Preferably, lengths L4, L5, L6, L9 and L10 are approximately three inches less than lengths L2, L3, L7, and L8. Length L1 is preferably slightly longer than lengths L2, L3, L7, and L8 as shown in FIG. 9.

Door 16 includes first and second gear racks 108 and 110 mounted to the first and second side portions 90 and 92, respectively. First and second gear racks 108 and 110 extend lengthwise on door 16 approximately coterminous with opening 104 and solid section 100. First gear rack 108 engages first gear 84, and second gear rack 110 engages the second gear (not shown) described above. Gear racks 108 and 110 are positioned on an upper side of door 16. It is also within the scope of the invention for gear racks 108 and 110 to be positioned on a bottom side of door 16, in which case shaft 72 and gear 84 would be positioned beneath door 16. Door stops 112 and 114 are mounted on the upper side of door 16 adjacent first end 94.

Figure 2:
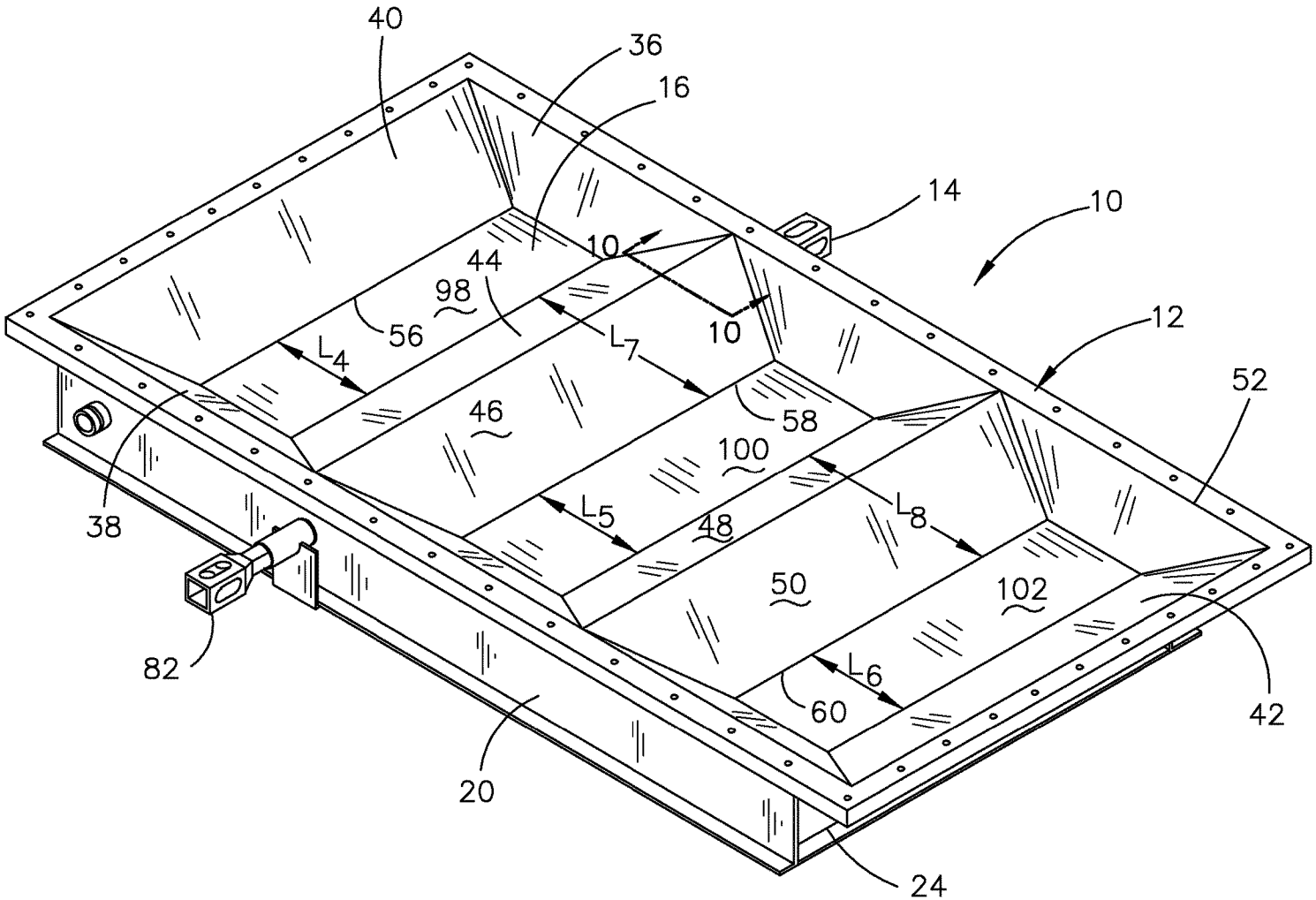
FIG. 2 is a perspective view of the hopper car gate of FIG. 1 with the door in a closed position.
Figure 3:
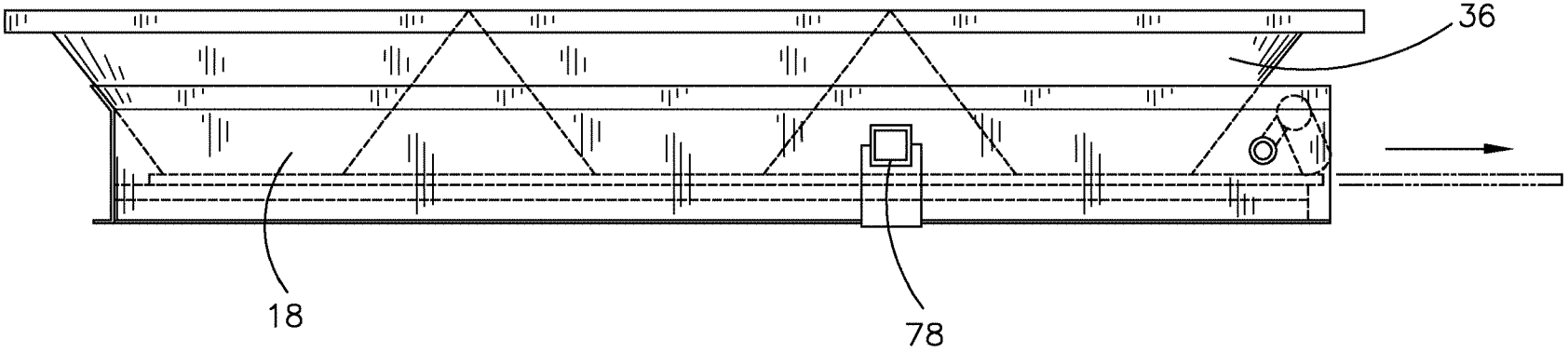
FIG. 3 is a side elevational view of the hopper car gate of FIG. 1.

In operation, the hopper car to which hopper car gate 10 is mounted is loaded with cargo when door 16 is in the closed position shown in FIG. 2 and transported to its destination. In the closed position, solid sections 98, 100, and 102 of door 16 block openings 56, 58, and 60, respectively, of frame 12. The cargo is discharged by inserting a tool within one of sockets 78 or 82 and rotating the socket and shaft 72 in the counter-clockwise direction, when viewed as shown in FIG. 3. Rotation of shaft 72 causes first gear 84 and second gear (not shown) to engage first and second gear racks 108 and 110 and move door 16 to the open position shown in FIG. 1. In the open position, openings 104 and 106 in door 16 are aligned with the first and second openings 56 and 58 in frame 12, respectively, and third opening 60 is unblocked by door 16. In the open position, first and second dividing walls 44 and 46 of frame 12 are aligned with and positioned above the second solid section 100 of door 16, and third and fourth dividing walls 48 and 50 are aligned with and positioned above the third solid section 102 of door 16.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A hopper car gate comprising:

a frame comprising at least one side wall coupled to at least one end wall and a flange coupled to the side wall and the end wall, wherein the flange is configured for mounting the frame to a railcar, the frame comprising at least first and second openings and a solid section positioned between the first and second openings;

an operating mechanism comprising a shaft coupled to the frame and at least one gear mounted to the shaft, wherein at least a portion of the shaft is positioned under the solid section of the frame; and a door supported by the frame and comprising a gear rack that engages the gear, wherein the door comprises at least first and second solid sections with an opening positioned between the first and second solid sections, and wherein rotation of the shaft is operable to move the door between a closed position, in which the first and second solid sections of the door block the first and second openings in the frame, respectively, and an open position, in which the opening in the door is aligned with at least one of the first and second openings in the frame and the solid section of the frame is aligned with at least one of the first and second solid sections of the door, and wherein the door moves from the closed position to the open position in a direction that is generally perpendicular to the shaft.

2. The hopper car gate of claim 1, wherein the door comprises a central portion comprising the first and second solid sections and the opening of the door, a first side portion coupled to and extending outward from a first side of the central portion, and a second side portion coupled to and extending outward from a second side of the central portion, wherein each of the first and second side portions is continuous and solid.

3. The hopper car gate of claim 2, wherein the gear rack is mounted to one of the first and second side portions.

4. The hopper car gate of claim 3, wherein a second gear rack is mounted to the other of the first and second side portions of the door, and wherein the operating mechanism comprises a second gear that engages the second gear rack.

5. The hopper car gate of claim 1, wherein the frame comprises a third opening and a second solid section positioned between the second and third openings, wherein the door comprises a third solid section and a second opening that is positioned between the second and third solid sections of the door, wherein when the door is in the closed position the third solid section of the door blocks the third opening in the frame, and wherein when the door is in the open position the second opening in the door is aligned with the second opening in the frame and the second solid section of the frame is aligned with the third solid section of the door.

6. The hopper car gate of claim 1, wherein the frame comprises first and second side walls each coupled with first and second end walls, wherein the solid section of the frame comprises first and second dividing walls extending between the first and second side walls, wherein the first opening in the frame is formed by the first end wall, the first and second side walls, and the first dividing wall.

7. The hopper car gate of claim 1, wherein the gear rack is positioned on an upper side of the door.

8. A hopper car gate comprising:

a frame comprising at least one side wall coupled to at least one end wall and a flange coupled to the side wall and the end wall, wherein the flange is configured for mounting the frame to a railcar, the frame comprising at least first and second openings and a solid section positioned between the first and second openings;

an operating mechanism comprising a shaft coupled to the frame, wherein at least a portion of the shaft is positioned under the solid section of the frame; and a door supported by the frame, wherein the door comprises a central portion, a first side portion coupled to and extending outward from a first side of the central portion, and a second side portion coupled to and extending outward from a second side of the central portion, wherein each of the first and second side portions is continuous and solid, wherein the central portion comprises at least first and second solid sections with an opening positioned between the first and second solid sections, and wherein the door is movable by the operating mechanism between a closed position, in which the first and second solid sections of the door block the first and second openings in the frame, respectively, and an open position, in which the opening in the door is aligned with at least one of the first and second openings in the frame and the solid section of the frame is aligned with at least one of the first and second solid sections of the door, and wherein the door moves from the closed position to the open position in a direction that is generally perpendicular to the shaft.

9. The hopper car gate of claim 8, wherein the frame comprises a third opening and a second solid section positioned between the second and third openings, wherein the door comprises a third solid section and a second opening that is positioned between the second and third solid sections of the door, wherein when the door is in the closed position the third solid section of the door blocks the third opening in the frame, and wherein when the door is in the open position the second opening in the door is aligned with the second opening in the frame and the second solid section of the frame is aligned with the third solid section of the door.

10. The hopper car gate of claim 8, wherein the frame comprises first and second side walls each coupled with first and second end walls, wherein the solid section of the frame comprises first and second dividing walls extending between the first and second side walls, wherein the first opening in the frame is formed by the first end wall, the first and second side walls, and the first dividing wall, and wherein the second opening in the frame is formed by the second end wall, the first and second side walls, and the second dividing wall.

11. A hopper car gate comprising:

a frame comprising first and second side walls each coupled with first and second end walls, first and second dividing walls extending between the first and second side walls, and a flange coupled to the first and second side walls and the first and second end walls, wherein the flange is configured for mounting the frame to a railcar, wherein a first opening in the frame is formed by the first end wall, the first and second side walls, and the first dividing wall, wherein a second opening in the frame is formed by the second end wall, the first and second side walls, and the second dividing wall, and wherein the first and second dividing walls are positioned between the first and second openings;

an operating mechanism comprising a shaft coupled to the frame and at least one gear mounted to the shaft, wherein at least a portion of the shaft is positioned under the first and second dividing walls; and a door supported by the frame, wherein the door comprises a central portion, a first side portion coupled to and extending outward from a first side of the central portion, a second side portion coupled to and extending outward from a second side of the central portion, and a gear rack that is mounted to one of the first and second side portions and that engages the gear, wherein each of the first and second side portions is continuous and solid, wherein the central portion comprises at least first and second solid sections with an opening positioned between the first and second solid sections, and wherein rotation of the shaft is operable to move the door between a closed position, in which the first and second solid sections of the door block the first and second openings in the frame, respectively, and an open position, in which the opening in the door is aligned with at least one of the first and second openings in the frame and the first and second dividing walls of the frame are aligned with at least one of the first and second solid sections of the door, and wherein the door moves from the closed position to the open position in a direction that is generally perpendicular to the shaft.

12. The hopper car gate of claim 11, wherein the frame comprises a third opening and third and fourth dividing walls positioned between the second and third openings, wherein the central portion of the door comprises a third solid section and a second opening that is positioned between the second and third solid sections of the door, wherein when the door is in the closed position the third solid section of the door blocks the third opening in the frame, and wherein when the door is in the open position the second opening in the door is aligned with the second opening in the frame and the third and fourth dividing walls are aligned with the third solid section of the door.

13. The hopper car gate of claim 11, wherein the gear rack is positioned on an upper side of the door.

14. The hopper car gate of claim 11, wherein a second gear rack is mounted to the other of the first and second side portions of the door, and wherein the operating mechanism comprises a second gear that engages the second gear rack.

* * * * *